US006600891B2

(12) United States Patent
Ooka et al.

(10) Patent No.: US 6,600,891 B2
(45) Date of Patent: Jul. 29, 2003

(54) MULTIPLE COLOR IMAGE FORMING APPARATUS AND METHOD

(75) Inventors: Haruhi Ooka, Kanagawa-ken (JP); Yasushi Shinjo, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/989,406

(22) Filed: Nov. 21, 2001

(65) Prior Publication Data

US 2002/0090231 A1 Jul. 11, 2002

(30) Foreign Application Priority Data

Nov. 22, 2000 (JP) ..... P2000-356100

(51) Int. Cl.[7] ..... G03G 15/10; G03G 9/00
(52) U.S. Cl. ..... 399/237; 430/114
(58) Field of Search ..... 399/57, 223, 237, 399/239, 240, 251, 231; 430/112, 114, 117

(56) References Cited

U.S. PATENT DOCUMENTS 4,728,983 A 3/1988 Zwadlo et al.
5,981,134 A * 11/1999 Miyamoto et al. ..... 430/114 X
6,205,312 B1 * 3/2001 Kim ..... 399/251 X
6,269,233 B1 * 7/2001 Yamaguchi ..... 399/237
6,272,304 B1 * 8/2001 Saito et al. ..... 399/237
6,282,392 B1 * 8/2001 Yamaguchi ..... 399/237

OTHER PUBLICATIONS

Hitoshi Yagi et al., "Image–on–Image Color Process Using Liquid Toner", IT&Ts NIP 16:2000 International Conference on Digital Printing Technologies, pp. 246–250.

* cited by examiner

*Primary Examiner*—Sandra Brase
(74) *Attorney, Agent, or Firm*—Oblon, Spivak, McClelland, Maier & Neustadt, P.C.

(57) ABSTRACT

A liquid developer electrophotographic apparatus and method for developing one or more successive color images on a previous color image formed on a latent image retaining body, wherein peeling off the previous color image is prevented by establishing a reversible electrophoretic transfer efficiency of toner particles in the previous toner image to be not greater than 60% in the liquid developer for the successive color image while applying an electrical potential difference between the latent image retaining body and a developing electrode for the successive developing step(s). A resin content and composition of the toner particles forming the previous color image may be selected to achieve the reversible electrophoretic transfer efficiency of 60% or less. Alternatively, or in conjunction with the selected resin content and composition, a heater is disposed in the vicinity of a successive developing station for development of the successive color image to heat the previous color image on the surface of the latent image retaining body so that the toner particles of the previous color image have the reversible electrophoretic transfer efficiency of 60% or less.

18 Claims, 2 Drawing Sheets

MULTIPLE COLOR IMAGE FORMING APPARATUS AND METHOD

CROSS-REFERENCE TO RELATED APPLICATIONS

This application claims the benefit of priority of Japanese patent Application No. 2000-356100, filed on Nov. 22, 2000, the entire contents of which are incorporated herein by reference.

BACKGROUND OF THE INVENTION

1. Field of the Invention

The present invention relates to a multiple color image forming apparatus and method wherein a multicolor image is formed on a substrate using a liquid developer.

2. Discussion of the Background

Image forming methods using a liquid developer, such as an electro-photographic recording method and an electrostatic recording method, have certain advantages that a dry toner developing apparatus cannot achieve. In particular, because the liquid developer contains fine toner particles of a sub-micron size dispersed in a carrier solvent, methods using liquid developers can accomplish high image quality. Also, because the liquid developer image forming methods can obtain a sufficient image density using even a small amount of toner particles, they are economical and can accomplish a fine texture equivalent to that of printing, such as offset printing.

Various electro-photographic recording methods for forming a multiple color image are known.

A first known method uses four latent image retaining bodies, and simultaneously performs formation of latent images on respective latent image retaining bodies and development of each of the latent images for these latent image retaining bodies, and thereafter transfers sequentially developed visible images to a transfer body to form a superposed multicolor image on the transfer body.

A second known method uses only one latent image retaining body, and performs image formation by forming a latent image, developing the latent image, and transferring the developed image to a transfer body. The steps are sequentially repeated for each of several color images and a superposed multicolor image is formed on the transfer body.

A third known method uses serial sets of latent image formation and development devices to form serially stacked color images onto one latent image retaining body, whereby stacked multiple color image laminates defining a multiple color visible image are formed on the surface of the latent image retaining body and collectively transferred to a transfer body. This method, called the "Image on Image Process (IOI process)," is preferable from the standpoint of achieving a reduction in the size of the apparatus and precision of color registration.

Nevertheless, the IOI process has a disadvantage caused by a peel off of a part of the toner particles of one color developed on a latent image retaining body from the latent image retaining body at a next color development station. The peel off may cause a degradation of image quality.

SUMMARY OF THE INVENTION

An object of the present invention is to provide a multiple color image forming apparatus and method in which peel off of toner particles of a previous color image from a latent image retaining body is suppressed, whereby a stable fine texture may be obtained.

Accordingly, according to a first aspect of the present invention, there is provided a multiple color image forming apparatus including a latent image retaining body, a first developing device, and a second developing device. The first developing device faces the latent image retaining body at a first developing station and is configured to develop a first latent image on the latent image retaining body using a first color liquid developer. The first color liquid developer contains a first solvent and first toner particles. The second developing device faces the latent image retaining body at a second developing station. The latent image retaining body at the second developing station retains a second latent image and supports a first color image developed by the first developing device. The second liquid developing device is configured to develop the second latent image using a second color liquid developer, and a reversible electrophoretic transfer efficiency of the toner particles of the first color image in the second liquid developer is 60% or less.

According to a second aspect of the present invention, there is provided a multiple color image forming apparatus including a latent image retaining body, a first developing device, a second developing device, and means for adjusting reversible electrophoretic transfer efficiency. The first developing device faces the latent image retaining body at a first developing station and is configured to develop a first latent image on the latent image retaining body using a first liquid developer. The first liquid developer contains a solvent and toner particles. The second developing device faces the latent image retaining body at a second developing station, and the latent image retaining body at the second developing station retains a second latent image and supports a first color image developed by the first developing device. The second developing device is configured to develop the second latent image using a second liquid developer. The reversible electrophoretic transfer efficiency of the toner particles of the first color image in the second liquid developer is set to be 60% or less by the means for adjusting.

According to a third aspect of the present invention, there is provided a multiple color image forming method including steps of forming a latent image on a latent image retaining body, which supports a first color image, and developing the latent image using a liquid developer. The first color image includes toner particles that have reversible electrophoretic transfer efficiency of 60% or less in the liquid developer.

BRIEF DESCRIPTION OF THE DRAWINGS

A more complete appreciation of the invention and many of the attendant advantages thereof is readily obtained as the state becomes better understood by reference to the following detailed description when considered in connection with the accompanying drawings, wherein.

DETAILED DESCRIPTION OF THE EMBODIMENTS

In various aspects, the present invention relates to a multicolor image forming apparatus and a multicolor image forming method using liquid developers.

Figure 1:
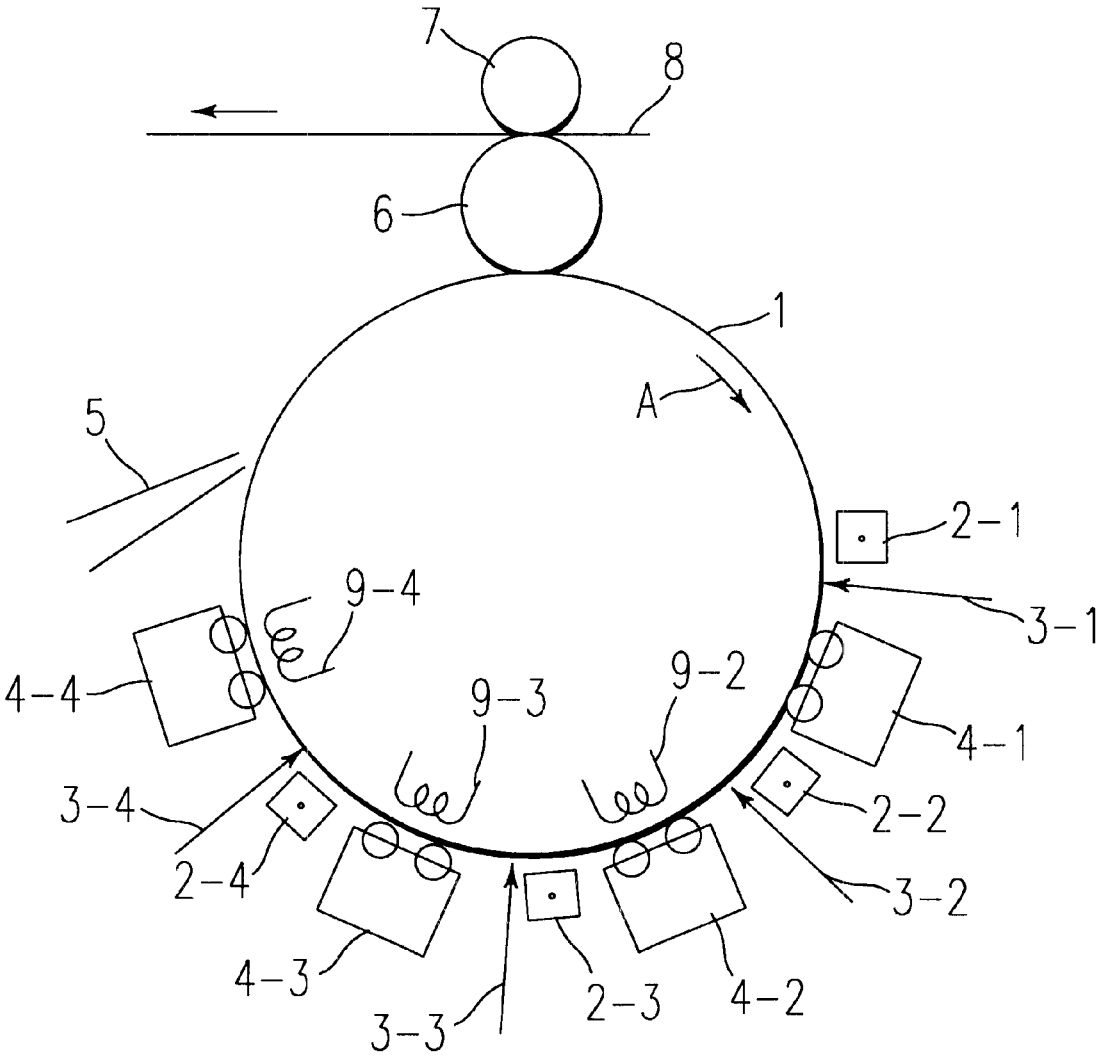
FIG. 1 is a cross-sectional view of an image forming apparatus according to a first embodiment of the present invention.

FIG. 1 is a cross-sectional view of a liquid developer image forming apparatus according to a first embodiment of the present invention.

The apparatus of FIG. 1 has a latent image retaining body 1 having a rigid base body and a photosensitive layer on the base body, and may be in the form of a photosensitive drum. The base body may be formed of an electrically conductive material such as aluminum, having a thickness of about 2 millimeters to 5 millimeters. The photosensitive layer may be an organic or an amorphous silicon photosensitive layer formed on an outer surface of the rigid base body. A release layer may be formed on a surface of the photosensitive layer.

The latent image retaining body 1 rotates in the direction represented by an arrow A in FIG. 1 and is electrically charged by a first charger 2-1, such as a corona charger, a corotron charger, or a scorotron charger. A first exposing device such as a laser transmitter emits an exposing light beam 3-1, thereby to form a first electrostatic latent image including an exposed area (image area) and a non-exposed area (non-image area).

The charger 2-1 charges the surface of the latent image retaining body 1 from about +500 V to about +1,000 V, and the exposing device applies the light beam 3-1 to predetermined area of the surface of the latent image retaining body 1 so that the surface potential of the image area of the latent image retaining body 1, which is supposed to have a maximum image density, is attenuated to about 0 to about +300 V.

A first developing device 4-1 in FIG. 1 develops the first electrostatic latent image using a first liquid developer and forms a first color image.

The first developing device 4-1 includes a container storing a first liquid developer.

The first developing device 4-1 also has a roller-shaped developing electrode (hereinafter called a "developing roller") which is arranged to face the latent image retaining body 1 at a first developing station and has applied thereto a developing voltage. When the developing roller rotates, the liquid developer is brought from the container to the developing station to fill up a developing gap between the latent image retaining body 1 and the developing roller.

The toner particles having a positive electrical potential receive an electrophoretic force directed to an area of the latent image retaining body 1 where the electrical potential is attenuated or discharged by the exposing light 3-1, whereby the first color image is formed. This developing process is called a discharged area development.

The present embodiment can also be applied to a charged area development wherein negatively charged toner particles develop an image of a charged area which has a higher electrical potential than other areas.

The developing voltage applied to the developing electrode may be set to a potential between the electrical potentials of the image and non-image areas of the latent image retaining body 1. The developing voltage may be set to form an electrical potential difference from an image area of a maximum density of about 200 to about 500 V.

The developing gap between the surface of the developing roller and the surface of the latent image retaining body 1 is generally set to about 10 to about 200 $\mu$m.

The liquid developer includes a non-polar carrier liquid such as ISOPAR L® (a product of Exxon Mobil Co.) and toner particles containing a colorant of a predetermined color and dispersed in the carrier liquid. The toner particle may be a mixture of a colorant and a resin.

A squeeze roller may be juxtaposed with the developing roller in the developing device 4-1, disposed to face the latent image retaining body 1, and rotated in a direction so as to remove the excessive carrier liquid from the surface of the latent image retaining body 1.

A second charger 2-2 of FIG. 1 charges the latent image retaining body 1 which supports the visible first color image on its surface. A second exposing device applies a second light beam 3-2 of FIG. 1 and selectively exposes the charged surface of the latent image retaining body 1, thereby forming a second electrostatic latent image having exposed and non-exposed areas.

The charging and exposure conditions established by the charger 2-2 and the exposing device for the second electrostatic latent image may be the same as or changed from those of the first color image.

A second developing device 4-2, which may have the same structure as that of the first developing device, develops the second electrostatic latent image. The device 4-2 may also have other structures that are known in the art and different from the first developing device. The second developing device 4-2 stores a second liquid developer using toner particles of a different color from that of the first color image.

A heater 9-2 in FIG. 1 is disposed at a second developing station, where the second developing device 4-2 faces the latent image retaining body 1, so as to adjust the surface temperature of the latent image retaining body 1 and/or the first color image at the second developing station. The heater 9-2 may be coupled to the latent image retaining body 1 around the second developing station to heat the first color image, or may be disposed near the outer surface of the latent image retaining body 1 to heat the first color image directly.

The second developing device 4-2 forms a second color toner image on the first color image on the surface of the latent image retaining body 1.

By performing similar steps through a plurality of times, a multicolor image is formed on the latent image retaining body and then may be brought into a substantial dry state (to the state where the carrier liquid is substantially removed from the developed image and only toner particles remain) by a suction valve 5 of FIG. 1.

The multicolor image formed on the surface of the latent image retaining body is transferred to a transfer medium 6 of FIG. 1 or a final substrate, such as a paper. The transfer medium 6 of FIG. 1 is arranged to contact with and receive a pressure from the latent image retaining body 1 to perform a pressure transfer.

The multicolor image on the surface of the latent image retaining body 1 may be transferred to the intermediate transfer medium 6 by a transfer method known in the art, for example the pressure transfer method. To transfer the multicolor image by pressure transfer, the latent image retaining body 1 and the intermediate transfer medium 6 may be brought into pressure contact at a first transfer station while an adhesion force of the multicolor image to the intermediate transfer medium 8 is arranged to be higher than an adhesion force to the latent image retaining body 1 by appropriate selection of surface materials of the medium 8 and the body 1.

In order to allow the toner particles to sufficiently exhibit their adhesion force at the first transfer station, it is preferred to heat the toner particles at or before the first transfer station by providing a heater at or near the first transfer station. The heater may be provided inside or outside of the transfer medium 6, and may be disposed between the suction valve 5 and the intermediate transfer medium 6 to face the latent image retaining body 1.

In place of the pressure transfer or with the pressure transfer, electrostatic or electrophoretic transfer may be used. A predetermined electric potential may be supplied to the intermediate transfer medium so that an electrostatic or electrophoretic force moves the toner particles towards the intermediate transfer medium 6 from the latent image retaining body 1.

The toner particles according to an example of the present invention have low reversible electrophoretic transfer efficiency as described below. Therefore, a transfer utilizing the pressure transfer may have a higher transfer efficiency than a transfer that utilizes electrostatic or electrophoretic transfer alone, and only small amounts of toner particles may remain on the surface of the latent image retaining body 1 by the method utilizing the pressure transfer.

The multicolor image transferred to the intermediate transfer medium 6 is then transferred to a recording medium such as a paper sheet 8 at a second transfer station where the intermediate transfer medium 6 faces a back-up roller 7. The sheet 8 is kept in pressure contact with the intermediate transfer medium 6 by the back-up roller (a pressure roller) 7, and pressure contact is employed to transfer the multicolor image on the surface of the intermediate transfer medium 6 to the sheet 8. The second transfer to this sheet 8 can be executed in combination or in substitution with the electrostatic transfer.

A direct transfer of the multicolor image from the latent image retaining body 1 to the recording medium 8 can be performed without using the intermediate transfer medium 6. The image may be transferred directly from the latent image retaining body 1 to the recording medium 8 by using the back-up roller 7 to provide a pressure or an electrostatic force to the multicolor image on the latent image retaining body 1. Applying the pressure from the back-up roller 7 to the latent image retaining body 1 during the direct transfer without using pressure may be preferable because of the low reversible electrophoretic transfer efficiency of the toner particles.

An electrostatic force is provided on the visible image formed on the surface of the latent image retaining body 1 during the second development. The second charger 2-2 charges the surface of the latent image retaining body 1 having the visible image of the first color to an electrical potential $V_c$, and the second exposing device selectively attenuates the potential of the latent image retaining body 1 by the laser beam 3-2 to form the electrostatic latent image of the second color. The second developing device 4-2 has a developing roller to which an electrical potential $V_d$ ($V_c \geqq V_d > 0$) is supplied and which develops the electrostatic latent image.

When the toner particles of the positive charge of the first toner image exist in an area not exposed by the second laser beam 3-2, the electrostatic force acts on the toner particles of the first toner image in the non-exposed area in a direction toward the developing electrode because of the electric field generated between the area of latent image retaining body 1(potential $V_c$) and the developing electrode (potential $V_d$). Therefore, a peel off of the toner particles of the first color image tends to happen and the toner particles tend to be removed from the latent image retaining body 1. The removed toner particles may then be brought into the second developing device 4-2 and mixed with the second color developer in the developing device 4-2. The mixture may cause deteriorations of the successive development of the second color image.

Through repeated experiments on the relationship between peel off of the toner images of the first color during the development of the second color and the electrophoretic characteristics of the liquid developer, according to the present invention, a threshold condition has been found where the toner particles of the first color do not peel off while satisfying the relation $V_c \geqq V_d$.

In other words, according to the present invention, it has been found that when toner particles that have a reversible electrophoretic transfer efficiency in the second liquid developer of not greater than about 60% are used as the toner particles of the first color, peel off of the toner particles of the first color image does not occur during development of the second or other successive color image(s), and an appropriate development can be performed at the area having the electrical potential $V_c$($V_c \geqq V_d$).

The term "reversible electrophoretic transfer efficiency" of the toner particles at the second developing station or other successive developing stations represents a ratio of the toner particles that undergo electrophoresis and peel off from an electro-deposited film formed on one electrode towards the other electrode. The electro-deposited film is formed by providing the liquid developer (the carrier liquid and the toner particles) between the pair of electrodes which are maintained at a certain electrical potential difference across the pair of electrodes. The electro-deposited film is formed through an electrophoresis movement of the toner particles in the liquid developer towards one of the pair of electrodes. After the toner particles are sufficiently aggregated to form the electro-deposited film, an inverse voltage is applied across the pair of electrodes. Part of the toner particles that peel off from the electro-deposited film and undergo electrophoresis towards the other electrode is measured and the ratio of the toner particles peeled off among all toner particles is calculated. The pair of electrodes correspond to the latent image retaining body 1 having the electrical potential and the developing electrode of the developing surface of the second/or other successive developing device. The electro-deposited film corresponds to the developed color image on the latent image retaining body 1.

Reversible electrophoretic transfer efficiency of the toner particles can be adjusted by, for example, controlling a resin composition in the toner particles. This reversible electrophoretic transfer efficiency can also be lowered by, for example, increasing a ratio of a resin having a low glass transition point, or by increasing a ratio of a resin having high solubility in the carrier liquid.

Because the reversible electrophoretic transfer efficiency decreases with an elevated temperature, it can be adjusted by carrying out the second toner image forming step at a higher temperature, for example at a heated condition or by keeping the latent image retaining body under the heated state by heating the second liquid developer.

The following example provides further explanation of the relationship between the reversible electrophoretic transfer efficiency of the liquid developer and peel off of a previously developed toner image, such as the first color image.

1) The Liquid Developer

ISOPAR-L® (a product of Exxon Mobil Co.) was used as a carrier solvent of the first liquid developer. "Cyanine blue-KRO," a product of Sanyo Pigment Co., was used as a pigment (colorant) of the toner particles. Several kinds of acrylic ester resins were prepared by selecting and combining arbitrary monomers from acrylic acid, vinyl acetate, styrene, lauryl acrylate, lauryl methacrylate, butyl acrylate, butyl methacrylate, ethyl acrylate, ethyl methacrylate, methyl acrylate and methyl methacrylate. The weight ratio of these resins to the pigment was 4:1 or 7:3.

These resins, pigment and dispersant were mixed and dispersed with the carrier liquid in the presence of glass beads inside a paint shaker to obtain a concentrated developer. The concentrated developer was diluted so that the concentration of the toner particle component becomes 1 part by weight. Further, 10 parts by weight of zirconium naphthenate, a product of Dai-Nippon Ink Co., relative to the amount of the toner particle component, was added.

In this way, five kinds of first liquid developers (liquid developers a to e) each having a different toner particle composition were prepared.

To confirm peel off of the first color image, the second liquid developer includes only ISOPAR-L® without containing the toner particles in this experiment.

2) Evaluation of Characteristics of Liquid Developer

The reversible electrophoretic transfer efficiency of the toner particles in each of the resulting five liquid developers was measured in the following way.

First, a pair of ITO (indium tin oxide) transparent electrodes were arranged to face each other while sandwiching a 300 μm-thick Teflon sheet-like spacer between them to prepare a parallel flat sheet electrode cell.

The liquid developer (a) was charged between the electrodes of the parallel flat sheet electrode cell, and a DC voltage of about 200 V applied across the pair of ITO transparent electrodes for 10 seconds. The toner particles charged to a positive charge underwent electrophoresis, migrated towards a negative plate of the pair of electrodes, and formed an electro-deposited film.

An inverse voltage of about 200 V was then applied to the parallel flat sheet electrode cell for 10 seconds. At this time, a part of the toner particles remained adhered to the ITO transparent electrode and formed the electro-deposited film, and another part of the toner particles repeatedly undergoing electrophoresis adhered to the other ITO electrode. As a result, the toner particles adhered to both of the ITO transparent electrodes.

Thereafter, the cell was decomposed, the carrier liquid dried and the respective electrodes having the toner particles deposited thereto heated at 150° C. for 10 minutes to melt the toner particles. Optical transmission factors of these two electrodes with the melted toner particles was measured.

The reversible electrophoretic transfer efficiency of each of the liquid developers (a) to (e) used as the first liquid developer was measured, and the transfer efficiency for the liquid developer (a) was 10%, that of the liquid developer (b) was 50%, that of the liquid developer (c) was 60%, that of the liquid developer (d) was 70%, and that of the liquid developer (e) was 100%.

3) Condition of Liquid Developer Electrophotographic Apparatus

The latent image retaining body 1 was a photosensitive drum having an organic photosensitive layer formed on the surface of an about 5 mm-thick aluminum drum, and an about 1 μm-thick silicone hard coat layer on the photosensitive layer.

The chargers 2-1 and 2-2 were a Scorotron charger and the surface of the latent image retaining body 1 was set so that the non-image area is charged to 800 V ($V_c$ was 800 V).

Each of the first and second developing devices 4-1 and 4-2 had a developing roller of a diameter of about 17 mmϕ and a squeeze roller of a diameter of about 17 mmϕ. Each of the developing rollers was arranged to have a developing gap of about 150 μm and each of the squeeze rollers was arranged to have a squeezing gap of about 50 μm.

An electrical potential of 600 V was supplied to the developing roller and the squeeze roller of the first developing device 4-1. A variable power source was used for the developing roller and the squeeze roller of the developing device 4-2 so that an electrical potential $V_b$ supplied to the respective rollers could be varied to an arbitrary value.

The first exposing device exposed an image area of the photosensitive drum, attenuated the potential of the exposed area to about 400 V by the laser beam 3-1, and exposed an area of 30 mm×30 mm square on the surface of the latent image retaining body 1 where the toner particles of the first liquid developer adhered.

The second exposing device did not apply the laser beam so as not to form a second latent image, whereby the second color image was not formed on the first color image.

The second developing device 4-2 had the same construction as that of the first developing device 4-1. An arbitrary electrical potential $V_d$ was applied to the developing electrode and to the squeeze roller of the second developing device. The electrical potential of the developing electrode and the squeezing roller may be different from each other.

In other words, as the electrical potential $V_d$ supplied to the developing roller of the second developing device 2-2 was varied to an arbitrary value, the relation between a threshold of a potential difference ($V_c$–$V_d$) and occurrence rates of peel off of the first toner image during the second development was examined.

The visible image formed on the latent image retaining body 1 was pressure-transferred to the intermediate transfer medium 6 that was arranged so as to keep pressure contact with the latent image retaining body 1. The intermediate transfer medium 6 may include a drum having an about 1 mm-thick urethane rubber layer on its surface. The intermediate transfer drum 6 was brought into pressure contact with the latent image retaining body 1 at a weight of about 50 kg per a width of A4 sheet size. The latent image retaining body 1 was kept at room temperature and the intermediate transfer drum 6 was kept at about 100° C.

The image on the intermediate transfer drum 6 was pressure-transferred and fixed to the sheet 8 conveyed between the intermediate transfer drum 6 and the pressure roller 7 which was disposed to keep a pressure contact with the intermediate transfer drum 6 to form a final image on the sheet 8. The pressure roller 7 was brought into pressure contact with the intermediate transfer drum 6 at about 50 kg per the width of A4 sheet size and was heated and held at about 100° C.

4) Evaluation 4-1) Preparation of Reference Sample

The visible image obtained by the first image forming step was as such transferred to the intermediate transfer medium 6 without forming a second color image and was further transferred from this intermediate transfer medium 6 to the sheet 8. The optical density of each image obtained by using the liquid developers (a) to (e) as the first liquid developer at the first developing station was measured with a Macbeth densitometer RD-914 (a product of Process Measurements Inc.) and was used as a reference density.

4-2) Peel Off Evaluation of Visible Image

An image was formed on the sheet 8 by using the liquid developer (a) as the first liquid developer in the liquid developer electrophotographic apparatus. The threshold value of ($V_c$–$V_d$) where the optical density of the image formed on the sheet decreases was examined with respect to the reference density by changing the electrical potential $V_d$ supplied to the developing roller of the second developing device 4-2.

In other words, the threshold value of $(V_c-V_d)$, where peel off of the first color image occurred by an effect of the second developing device, was examined.

The threshold value of the drop of the density relative to the reference density using each of the liquid developers (b) to (e) was examined.

Figure 2:
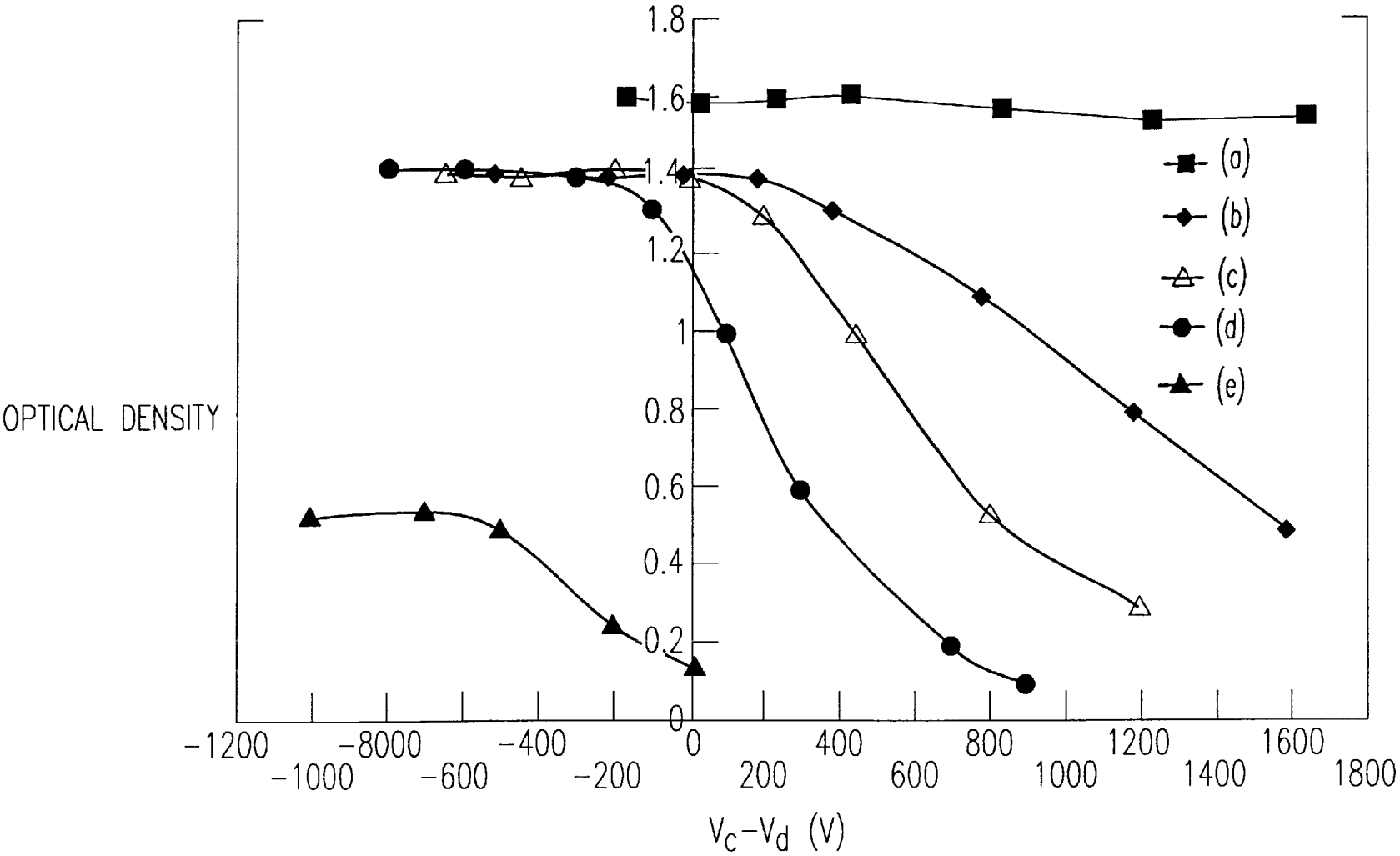
FIG. 2 is a diagram of a relation between an optical density of images and a difference between an electrical potential $V_c$ of a latent image retaining body and an electrical potential $V_d$ of a developing electrode.

The result is shown in Table 1 and the relation between the image density and $(V_c-V_d)$ obtained by this experiment is shown in the graph of FIG. 2. Table 2 also shows the composition of the toner particles in the liquid developers (a) to (e).

TABLE 1

| | Reversible electrophoretic transfer efficiency (%) | Threshold of $V_c-V_d$ (V) |
|---|---|---|
| Liquid developer (a) | 10 | 1600 or more |
| Liquid developer (b) | 50 | 380 |
| Liquid developer (c) | 60 | 0 |
| Liquid developer (d) | 70 | −100 |
| Liquid developer (e) | 100 | −500 |

TABLE 2

| | Monomer weight ratio of resin (%) | | Resin/pigment weight ratio (%) |
|---|---|---|---|
| Liquid developer (a) | Lauryl methacrylate 80 | Acrylic acid 20 | 80/20 |
| Liquid developer (b) | Lauryl methacrylate 50 | Methyl methacrylate 60 | 80/20 |
| Liquid developer (c) | Lauryl methacrylate 40 | Methyl methacrylate 60 | 80/20 |
| Liquid developer (d) | Lauryl methacrylate 40 | Methyl methacrylate 60 | 70/30 |
| Liquid developer (e) | Methyl methacrylate 80 | Styrene 20 | 80/20 |

Table 1 and FIG. 2 show the liquid developer having reversible electrophoretic transfer efficiency of less than 60% is appropriate to prevent peel off of the previously formed color image and to satisfy the relation, $V_c-V_d \geqq 0$. The optical density of the liquid developer (d) starts to decrease at a region where $(V_c-V_d)$ is less than 0, which means that unexpected deposition of the toner particles of the successive developer may happen at a non-image area.

For further study, the latent image retaining body 1 and the intermediate transfer body 6 were brought into mutual contact without substantial pressure/weight between each other, and an image output was conducted in the same way as in the above described example with an exception that the electrical potential of the intermediate transfer body 6 was kept at 0 V whereby electrostatic transfer was conducted. As a result, the multiple color image transferred by the pressure transfer was completely transferred to the intermediate transfer body 6. The multiple color image transferred by the electrostatic transfer was not good as obtained by pressure transfer but nevertheless had good transfer efficiency. An electrostatic transfer by applying an electrical potential of −1500 V to the intermediate transfer body 6 conducted the image transfer much more than the image by the electrical potential of 0 V applied to the intermediate transfer body 6. A shearing transfer may also be employed at the first transfer station especially for the transfer of the image from the photosensitive layer, which is not covered with the release layer. Examples of the method and structure for the shearing transfer are disclosed in a U.S. patent application, Ser. No. 09/662,829, and the entire contents of which are incorporated herein by reference. Therefore the transfer method may preferably be selected from those methods in accordance with the expected results. The electrical potential less than −1500 V may provide a discharge or a deterioration of the intermediate transfer body 6.

As described above, the present invention can prevent peel off of the toner particles forming the visible image of the previously developed color image formed on the surface of the latent image retaining body during a successive developing step during development of a multicolor image on a latent image retaining body. This is achieved either by means of the type and/or amount of resin(s) employed in the liquid toner image or by applying heat to the previously formed toner image at the successive development station, or by a combination of judicious resin selection and heat application. Application of heat is performed by means of a heater disposed in the vicinity of the successive developer station whereby heat can be either directly or indirectly applied to the previously formed liquid toner image. In this context, the vicinity of the successive developer station includes either side of the latent image retaining body for direct heating of the latent image retaining body at the successive developer station. Within the scope of the present invention, the vicinity of the successive developer station also includes inside or outside of the container for liquid developer at the successive developer station, whereby the previously developed image can be indirectly heated by heating successive developer in its container at the second developer station and applying the heated successive developer to the previously formed image to transfer heat from the heated successive developer to the previously developed image.

Although the present invention has been particularly shown and described with reference to an embodiment thereof, it will be understood by those skilled in the art that various other changes in the form and details may be made therein without departing from the spirit and scope of the invention.

What is claimed as new and desired to be secured by Letters Patent of the U.S. is:

1. A multiple color image forming apparatus, comprising;

a latent image retaining body;

a first developing device facing the latent image retaining body at a first developing station and configured to develop a first latent image on the latent image retaining body, using a first color liquid developer containing a solvent and toner particles, and thereby form a first color image; and a second developing device facing the latent image retaining body at a second developing station and configured to develop a second latent image formed on the latent image retaining body into a second color image in registration with the first color image, using a second color liquid developer, wherein a reversible electrophoretic transfer efficiency of the toner particles of the first color image in the second color liquid developer is 60% or less.

2. The apparatus of claim 1, further comprising a heater disposed in the vicinity of the second developing station.

3. The apparatus of claim 1, wherein the toner particles contain a resin having an amount and composition selected so that the reversible electrophoretic transfer efficiency is 60% or less.

4. The apparatus of claim 1, further comprising:

a transfer unit coupled to the latent image retaining body and configured to transfer a multiple color image on the latent image retaining body to a receptor, the multiple color image including the first color image and the second color image.

5. The apparatus of claim 4, wherein the transfer unit comprises:

an intermediate transfer surface facing and pressed against the latent image retaining body at a transfer station.

6. A multiple color image forming apparatus, comprising;

a latent image retaining body;

a first developing device facing the latent image retaining body at a first developing station and configured to develop a first latent image on the latent image retaining body into a first color image, using a first color liquid developer containing a solvent and toner particles;

a second developing device facing the latent image retaining body at a second developing station and configured to develop a second latent image formed on the latent image retaining body into a second color image in registration with the first color image, using a second color liquid developer; and means for setting a reversible electrophoretic transfer efficiency of the toner particles of the first color image in the second color liquid developer to be 60% or less.

7. The apparatus of claim 6, wherein the means for adjusting the reversible electrophoretic transfer efficiency comprises a heater disposed in the vicinity of the second developing station.

8. The apparatus of claim 6, further comprising:

a transfer unit coupled to the latent image retaining body at a transfer station and configured to transfer a multiple color image including the first color image and the second color image on the latent image retaining body to a receptor.

9. The apparatus of claim 8, wherein the transfer unit comprises:

an intermediate transfer surface facing and pressed against the latent image retaining body at the transfer station.

10. A multiple color image forming method comprising:

forming a latent image comprising toner particles on a latent image retaining body supporting a first color image; and developing the latent image to a second color image in registration with the first color image using a liquid developer in which the toner particles of the first color image have a reversible electrophoretic transfer efficiency of 60% or less.

11. The multiple color image forming method of claim 10, further comprising:

transferring a multiple color image from the latent image retaining body to a receptor, the multiple color image including the first color image and the second color image.

12. The multiple color image forming method of claim 11, wherein the step of transferring the images comprises:

applying a pressure between the latent image retaining body and the receptor.

13. The multiple color image forming method of claim 10, further comprising:

heating the latent image retaining body during the developing step.

14. The multiple color image forming method of claim 10, further comprising:

heating the first color image during or before the developing step.

15. The multiple color image forming method of claim 10, comprising:

using as the liquid developer a liquid developer containing a plurality of toner particles having a color different from the first toner particles.

16. The multiple color image forming method of claim 10, comprising:

forming the first color image using a liquid developer including toner particles containing a resin having a composition and an amount selected so that the toner particles have the reversible electrophoretic transfer efficiency of 60% or less.

17. The multiple color image forming method of claim 16, comprising:

using as the resin a resin having a sufficiently low glass transition point, or a sufficiently high solubility in the carrier liquid, to obtain said reversible transfer efficiency of 60% or less.

18. The multiple color image forming method of claim 10, wherein:

the step of forming the latent image comprises charging the latent image retaining body to an electrical potential $V_c$, the step of developing the latent image comprises providing an electrical potential $V_d$ to a developing surface facing the latent image retaining body, and the electrical potential $V_d$ of the developing surface is set to be equal to or less than the electrical potential $V_c$ of the charged latent image retaining body.

* * * * *